United States Patent [19]

Grant

[11] 4,086,467

[45] Apr. 25, 1978

[54] ELECTRONIC HEATER FOR HIGH VOLTAGE APPLICATIONS

[75] Inventor: John L. Grant, Halifax, Morocco

[73] Assignee: Texas Instruments Incorporated, Dallas, Tex.

[21] Appl. No.: 706,652

[22] Filed: Jul. 19, 1976

[51] Int. Cl.[2] ..... H05B 3/02; H01C 7/02

[52] U.S. Cl. ..... 219/544; 219/505; 219/536; 219/541; 338/22 R; 338/275

[58] Field of Search ..... 174/16 HS, 52 PE; 338/275, 22 R, 23, 25-28, 248, 250, 253, 269, 51, 274; 219/209, 210, 504, 505, 541, 544, 548, 345, 336, 538, 338

[56] References Cited

U.S. PATENT DOCUMENTS

| | | | |
|---|---|---|---|
| 2,358,211 | 9/1944 | Christensen et al. | 338/22 R |
| 2,489,409 | 11/1949 | Green et al. | 339/275 |
| 2,786,819 | 3/1957 | Smith et al. | 338/22 R |
| 3,284,418 | 11/1966 | Wildi | 338/22 R |
| 3,286,214 | 11/1966 | Kolb et al. | 338/28 X |
| 3,444,399 | 5/1969 | Jones | 219/209 X |
| 3,541,489 | 11/1970 | Person | 338/51 |
| 3,719,796 | 3/1973 | Abildtrup | 338/22 R X |
| 3,748,439 | 7/1973 | Ting et al. | 338/22 X |
| 3,824,328 | 7/1974 | Ting et al. | 338/275 X |
| 3,829,598 | 8/1974 | Darrell | 174/16 HS |
| 3,940,591 | 2/1976 | Ting | 338/22 R |

*Primary Examiner*—Thomas J. Kozma
*Attorney, Agent, or Firm*—John A. Haug; James P. McAndrews

[57] ABSTRACT

A high voltage, high efficiency self-regulating heater comprises a thermally conductive housing having a chamber therein with a heating member in the chamber. The heating member includes a self-heating positive temperature coefficient (PTC) resistor element of a generally parallel-piped shape with its thickness dimension much less than its width dimension yielding two parallel face surfaces of larger area than two parallel edge surfaces. A layer of electrically conductive material is applied to the two parallel edge surfaces yielding an ohmic contact. The heater member further comprises two heat sink plates of thermally conductive, electrically insulating material which are positioned to engage the two broad face surfaces of the element. First and second terminal means are attached to the electrically conductive edge surfaces for supplying electrical power to the element to provide a heater in which the current flow is perpendicular to the major direction of heat flow to minimize banding of the element under high voltage use. The chamber is filled with an electrically insulating thermally conductive ceramic for providing good heat transfer.

8 Claims, 4 Drawing Figures

ELECTRONIC HEATER FOR HIGH VOLTAGE APPLICATIONS

BACKGROUND AND SUMMARY OF INVENTION

This invention relates to self-regulating heaters and more particularly to a high voltage self-regulating heater which may be applied to a refrigeration system compressor housing to maintain the lubricant therein above a predetermined temperature level.

In conventional refrigeration compressors, a refrigerant, such as one sold under the trademark "Freon" by E. I. duPont de Nemours, & Co., may, in liquid form, migrate from the condenser into the compressor lubricant. Then, when start-up of the compressor occurs, the sudden reduction in crankcase pressure may cause the refrigerant to boil, thus causing the lubricant to foam with consequent loss of lubrication to other mechanical parts of the compressor. It has been conventional to employ a crankcase heater to maintain the compressor crankcase at a temperature above that of the rest of the refrigeration system which prevents the migration of refrigerant into the crankcase lubricant.

In the prior art, fixed constant-resistance heaters were used for heating the crankcase. However, these heaters were not self-regulating and thus required the use of heat output temperature controls and the expense and low reliability associated with them. Self-regulating sump heaters such as disclosed in copending application entitled, Self-Regulating Electric Heater, Ser. No. 706,368 have proven useful in many applications.

These self-regulating heaters employ a heater made of ceramic material having a positive temperature coefficient (PTC) of resistivity. Such heaters have a relatively low resistance at usual ambient temperatures, but after initial energization by a source of electrical power will self-heat and increase their temperature and resistance. Heat will be generated and the resistance will increase rapidly above a threshold or anomaly temperature until the heat generated balances the heat dissipated at which time the temperature and resistance stabilize with the resistance many times inital value.

In certain applications particularly where a relatively high voltage is applied across the PTC heater prior art self-regulating heaters may exhibit banding phenomena of the PTC ceramic elements because of the thickness needed to maintain the electric field at an acceptable level. This banding phenomena causes a decrease in the resistivity characteristics of the heater as a whole and in an extreme case a complete breakdown of the heater material. Attempts have been made to try to overcome this problem by using a plurality of elements in series to try to divide the voltage evenly among them but this solution has caused difficulty, particularly where the resistivity characteristics of the plurality of elements are not identical which is often the case. Even if the matching of the elements in series can be accomplished, the matching is found to add to the cost of manufacturing the heater.

Accordingly it is an object of the present invention to provide an improved self-regulating heater especially useful for high voltage applications.

It is another object to provide a self-regulating heater with a low thermal resistance.

It is still another object to provide a self-regulating heater which is easy to assemble, inexpensive in construction, and reliable in operation. Other objects and features of this invention will be in part apparent and in part pointed out hereinafter.

Briefly, the self-regulating heater of this invention preferably comprises a D-shaped thermally conductive ceramic tube with a cap at one end defining a chamber therein. The chamber preferably contains a high thermal conductivity ceramic based potting compound and a self-regulating heater member. The heating member comprises a PTC heating element with two relatively large parallel face surfaces and two smaller parallel edge surfaces. A layer of electrically conductive material is applied to the two parallel edge surfaces yielding an ohmic contact. Two thermally conductive and electrically insulative heat sink plates are positioned to be in engagement with the two face surfaces and first and second terminals are attached to the electrically conductive edge surface for supplying electrical power to the element. After partial filling of the chamber with the ceramic potting compound and inserting the heating member with terminal means, the end of the tube opposite the cap is sealed with an RTV (Room Temperature Vulcanizing) silicone rubber compound to provide a water tight device.

In accordance with this invention the design of the heater provides for flow of electrical current through the heater material in a first direction between the ohmic contact layers. On the other hand, the location of the heat sink plates on the broad flat surfaces of the heater assures that the major flow of heat from the heater is in a second direction perpendicular to the direction of the current flow. This design of the heater provides for a device which is particularly adapted for use in high voltage applications. That is, the thickness between the two heat sink plates is small so as to assure that only a minimal temperature gradient exists from the center of the element to the heat sink plates. Further this arrangement substantially eliminates the existence of temperature gradients along the direction of electrical current flow thus little or no banding occurs. On the other hand the substantial thickness of material between the ohmic contact layers on the heater assures that a substantial voltage can be applied across the heater material without breakdown of the PTC material in the heater.

BRIEF DESCRIPTION OF THE DRAWINGS

Corresponding reference characters indicate corresponding parts throughout the several views of the drawings.

DESCRIPTION OF PREFERRED EMBODIMENT

Figure 3:
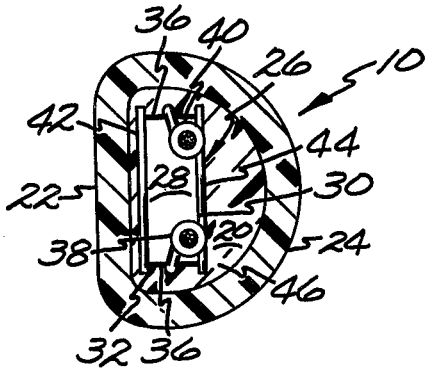
FIG. 3 is a horizontal cross-sectional view taken on line 3—3 of FIG. 1.

Referring now to drawings 1–3, a self-regulating heater 10 of this invention is shown with a housing member 12. Housing member 12 is preferably made from an extruded D-shaped tube 14 as best shown by FIG. 3 and a ceramic cap 18, both of which are made from an electrically insulating, thermally conductive material such as steatite. Cap 18 is secured to one end of tube 14 to define a chamber 20 therein with an open end.

Cap 18 may be secured to the tube with any suitable ceramic adhesive such as that commercially sold as Dow Corning 140. The housing preferably has a flat surface portion 22 and a major circular portion 24 with rounded corners or minor circular portions where the major circular portion meets the flat portion. The use of the D-shaped housing allows for easy assembly and economical manufacture while providing a design with excellent thermal conductivity for both external mount or internal well use for heating crankcase lubricant as fully described in the aforementioned copending application.

Figure 4:
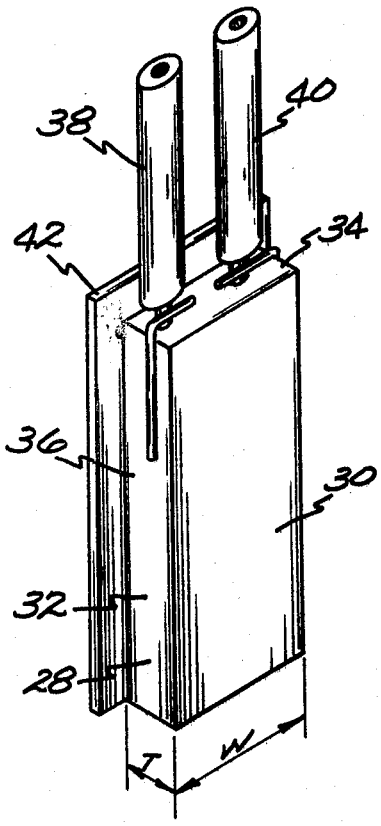
FIG. 4 is a perspective view of a heater element a heat sink plate and terminal means of the heater of this invention.

A self-regulating heating member is illustrated by numeral 26. Heating member 26 preferably includes a self-regulating heater element 28 which is a self-heating positive temperature coefficient (PTC) resistor of a ceramic material, e.g., a doped barium titanate, having low initial resistance which increases abruptly as the temperature rises above a given anomaly temperature until it reaches its equilibrium temperature. At its equilibrium temperature, the heat generated by the element is equal to the heat dissipated. The heating element has a generally parallelpiped shape with two broad face surface portions 30, two smaller edge surface portions 32 and two top surface portions 34. The two broad face surface portions 30 are generally parallel to one another and spaced by the thickness T as shown in FIG. 4 which is smaller than the width W which separates the edge surface portions 32. The edge surfaces 32 each have a layer of electrically conductive material 36 applied thereto for forming an ohmic contact surface. This conductive material does not extend along the face or top surface portions of the heating element.

First and second terminal means 38 and 40 are each secured to edge surfaces 32 for supplying electrical power to heating element 28. The voltage is applied across the width W of the element for keeping the electric field per unit of material thickness within a tolerable level even for high voltage applications so degradation that of the PTC element will not occur as will be more fully explained below.

A pair of heat sink plates 42 and 44 of an electrically insulating and thermally conductive material (e.g., aluminum oxide) are positioned to engage the two parallel face surface portions 32 of the heating elements. Plates 30 and 32 have a width so as to fit slidingly into chamber 20. That is, to be freely slidable in and out of the chamber while still being guided by the side walls around the chamber. The length of the plates extend beyond the ends of the element running nearly the entire length of the chamber.

Accordingly chamber 20 is preferably substantially filled with a ceramic potting compound 46, such as a densely filled phosphate or silicate bonded aluminum oxide compound. The compound is chemically set an forms and electrically nonconductive ionized species during curing with a high dielectric strength without firing, and is free from reducing agents such as amines found in epoxy curing agents which cause degradation of the PTC. Strongly polarized ions in the compound make a strong bond to tube 14 providing excellent thermal conductivity between the two. Specifically Aremco 510 manufactured by Aremco Products, Inc. has been found to be an excellent compound with a thermal conductivity in the range of 25 BTU inches/hr ° F ft$^2$.

Figure 2:
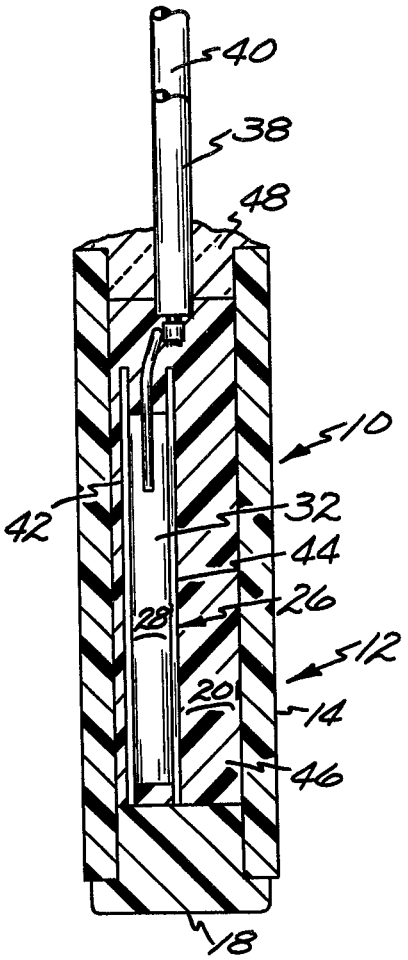
FIG. 2 is a section view of the self-regulating heater of FIG. 1.

Heating member 26 with element 28, terminals 38 and 40 and plates 42 and 44 are inserted into chamber 20 with compound 46 prior to the compound curing. The D-shape of the tube preferentially locates member 26 directly adjacent flat wall portion 22 while still providing sufficient clearance for easy insertion of the member and complete flow of ceramic compound 46 around it to leave no air pockets. More specifically the D-shaped housing chamber positions one plate directly adjacent an inner face of the flat housing surface portion and the edges of the second plate adjacent an inner face of the major circular housing portion. The ceramic compound 46 cured in situ holds the member 22 in place. The level of the compound in chamber 20 is provided to completely cover the heating member while also covering the bottom portion of terminal means 38 and 40 as shown by FIG. 2.

Accordingly a water tight seal 48 is provided to fill the top portion of the tube. The RTV adheres to the inside of the ceramic tube to provide a heater capable of being used when immersed in water.

Figure 1:
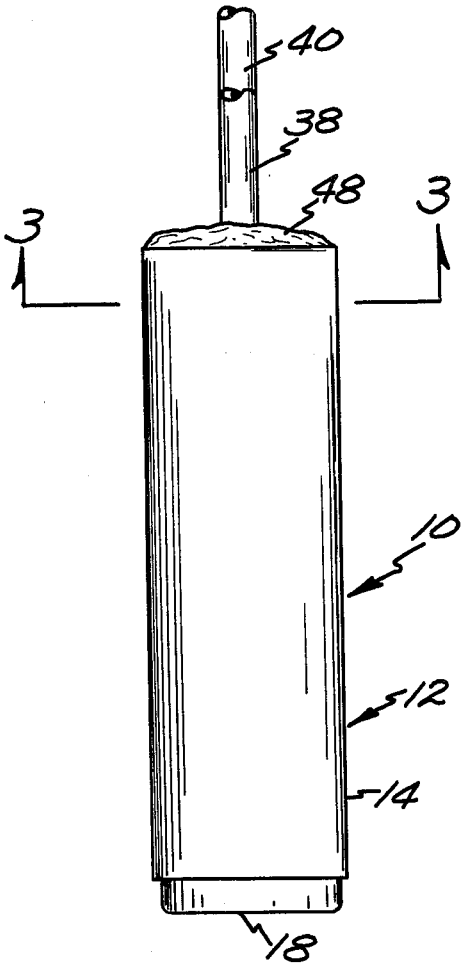
FIG. 1 is a front plan view of a self-regulating heater of this invention.

In the design of PTC heaters, the internal electric field must be kept within tolerance limits or the PTC characteristics will be degraded due to either sudden or gradual dielectric breakdown of the material. That is, if a portion of the heater body is subjected to an excessive electrical field or voltage drop across that heater portion, the resistance and other characteristics of that portion of the heater body can be degraded. A standard designing parameter is to keep the electric field less than 1.2 volts per thousandth of an inch of material. For high voltage applications this designing requirement can result in the requirement for a substantial thickness of PTC material between the contacts of the heater element. Further, where there are large temperature gradients across the substantial thickness of the material, these gradients can cause the resistivity across the element to also vary greatly thus causing the electric field within inner portions of the element body to likewise vary greatly thereby producing portions of the heater body which are subjected to greater than desired electrical field. In accordance with this invention this occurrence of these temperature gradients can be greatly reduced by physically displacing electrical and thermal contacting by 90°, as shown in heater 10 of FIGS. 1–3. The effect of such a configuration is to force the temperature gradients in the direction of current flow to be very small and in fact have the highest heat generated near the heat sink plate rather than in the center of the pill. Thus the resistivity gradients in the direction of current flow will also be very small and the electric field across each localized portion of the heater body will be very uniform. The capacity to dissipate substantial amounts of heat still exist because the large face surface portions are still heat sunk. An added beneficial factor is that the thickness T can be reduced without affecting the important voltage blocking width W thereby allowing for an element with smaller mass and therefore low cost.

Accordingly an easily assembled heater 10 has been shown both for internal well or external mount use as fully described in earlier mentioned copending application. The heater is especially well suited for high voltage applications yielding a highly reliable inexpensive device.

In view of the above, it will be seen that the several objectives of the invention are achieved and the other advantageous objects attained.

As various changes could be made in the above construction without departing from the scope of the invention, it is intended that all matter contained in the above description or shown in the accompanying drawings shall be interpreted as illustrative and not in a limiting sense.

I claim:

1. A self-regulating heater comprising:

a housing;

a heater assembly within said housing, said heater assembly incorporating a heating means constituted by a self-heating positive temperature coefficient resistor element having low initial resistance which increases abruptly as its temperature rises above a given level, said element of generally parallelpiped shape having a first or thickness dimension less than a second or width dimension yielding two parallel face surfaces of larger area than two parallel edge surfaces, said two parallel edge surfaces each having a layer of electrically conductive material applied thereto forming an ohmic contact surface thereon which is electrically spaced from the other layer by the heater material therebetween, said assembly further incorporating a pair of heat sink plates of thermally conductive material secured to said face surfaces; and terminal means connected to respective edge surfaces and extending from said housing for supplying electrical power to said element.

2. A self-regulating heater as set forth in claim 1 wherein said heat sink plates are electrically insulative.

3. A self-regulating heater comprising:

a housing having a closed end and an open end defining a chamber therein;

a heater assembly incorporating a heating means constituted by a self-heating positive temperature coefficient resistor element having low initial resistance which increases abruptly as its temperature rises above a given level, said element of generally parallelpiped shape having and first or thickness dimension less than a second or width dimension yielding two parallel face surfaces of larger area than two parallel edge surfaces, said two parallel edge surfaces having a layer of electrically conductive material applied thereto forming an ohmic contact surface thereon, said assembly further incorporating a pair of heat sink plates of thermally conductive, electrically insulative material secured to said face surfaces, said assembly being slidably fitted into said housing chamber;

terminal means connected to respective edge surfaces and extending from said open housing for supplying electrical power to said element; and sealing means for sealing the open end of said housing around said terminal means.

4. A self-regulating heater as set forth in claim 3 further providing for a thermally conductive electrically insulating ceramic cured in situ within the chamber to substantially fill said chamber around said assembly free of entrapped gases for providing excellent heat transfer between the assembly and said housing.

5. A self-regulating heater as set forth in claim 4 wherein said housing is made from a thermally conductive ceramic material.

6. A self-regulating heater as set forth in claim 5 wherein said sealing means is a potting material filling the remainder of said housing chamber.

7. A self-regulating heater as set forth in claim 3 wherein said plates are made from aluminum oxide.

8. A self-regulating heater comprising:

a thermally conductive tubular housing of a ceramic material having a closed end and an open end and having a D-shaped cross section with one flat surface portion and one major circular surface portion joined by two minor circular surface portions for defining a chamber therein of comparable D-shaped cross-section;

a heater assembly incorporating a heating means constitued by a self-heating positive temperature coefficient resistor element having low initial resistance which increases abruptly as its temperature rises above a given level, said element of generally parallelpiped shape having a first or thickness dimension less than a second or width dimension yielding two parallel face surfaces of larger area than two parallel edge surfaces, said two parallel edge surfaces having a layer of electrically conductive material applied thereto forming an ohmic contact surface thereon, said assembly further incorporating a pair of heat sink plates of thermally conductive, electrically insulative material secured to said face surfaces, said assembly being slidably fitted into said housing chamber;

a thermally conductive electrically insulating ceramic cured in situ within the chamber to substantially fill said chamber around said assembly free of entrapped gases for providing excellent heat transfer between the assembly and said housing;

terminal means connected to respective edge surfaces and extending from said open housing for supplying electrical power to said element; and a potting material filling the remainder of the volume of the housing chamber around said terminal means at the open housing end sealing said chamber.

* * * * *